United States Patent [19]

Hicks

[11] Patent Number: 4,775,124

[45] Date of Patent: Oct. 4, 1988

[54] SUSPENSION SOAP HOLDER

[76] Inventor: Donald D. Hicks, P.O. Box 321, Geraldine, Mont. 59446

[21] Appl. No.: 76,850

[22] Filed: Jul. 23, 1987

[51] Int. Cl.[4] ..... A47K 5/08

[52] U.S. Cl. ..... 248/175; 248/316.8; 206/77.1

[58] Field of Search ..... 248/465.1, 473, 153, 248/175, 302, 309.1, 310, 316.8; D6/532, 536, 537, 539, 540; 206/77.1

[56] References Cited

U.S. PATENT DOCUMENTS

| | | | |
|---|---|---|---|
| D. 146,306 | 2/1947 | Gray | D6/536 |
| D. 151,126 | 9/1948 | Hilenski | D6/536 |
| D. 179,683 | 2/1957 | Harrison | D6/537 |
| D. 247,999 | 5/1978 | Whatley | D6/536 |
| 331,057 | 11/1885 | Hendrix | 248/465.1 X |
| 2,205,064 | 6/1940 | Irwin | 248/175 |
| 2,461,374 | 2/1949 | Custer | 248/175 |
| 3,177,048 | 4/1965 | Whatley | 248/316.8 X |
| 3,343,774 | 9/1967 | Pryor | D6/536 X |
| 4,277,042 | 7/1981 | Ash, Sr. | D6/537 X |
| 4,589,556 | 5/1986 | Peretz | 211/181 X |
| 4,621,730 | 11/1986 | Mancusi, Jr. | D6/536 X |

FOREIGN PATENT DOCUMENTS

| | | | |
|---|---|---|---|
| 954063 | 6/1949 | France | 248/316.8 |
| 2413116 | 10/1974 | Fed. Rep. of Germany | 206/77.1 |
| 222767 | 11/1942 | Switzerland | 248/309.1 |
| 2034179 | 6/1980 | United Kingdom | 206/77.1 |

*Primary Examiner*—J. Franklin Foss
*Assistant Examiner*—Robert A. Olson
*Attorney, Agent, or Firm*—William D. West

[57] ABSTRACT

A bent wire soapholder for storing bar soap to allow for draining is disclosed. The soap holder provides minimal contact area with the soap bar, allows mechanical drainage of contact area and provides minimal contiguous surface area below the soap bar supports. The device provides base and soap bar supporting rods which extend forwardly, inwardly and downwardly from rear side of holder to the front. Each supporting member provides a pre-determined length of support surface and a lower V shaped point of drainage. Numerous attachments and base structures are also disclosed.

13 Claims, 2 Drawing Sheets

SUSPENSION SOAP HOLDER

BACKGROUND OF THE INVENTION

1. Field of the invention

This invention relates generally to a soapholder and in particular to a bent wire soapholder which provides drainage and storage for bar soap between periods of use.

2. Discussion of the Technical Problems

We soap is difficult to store properly. If the water is not drained, the soap becomes jelly-like and is nearly unusable.

To be efficiently stored, a solid emulsifying material such as bar soap must be as dry between uses as is possible, especially at any point of contact, to prevent absorption and subsequent softening and loss of emulsifying oils contained in the soap.

The soap contact area of the holder must be limited to the absolute minimum and any connected surface area beneath the support must also be as small as possible. Soap stubbornly retains moisture at points of contact with an material. Soap bar contact with the supporting device must be reduced to the smallest area needed to support the weight of the soap bar without gouging it.

The adjacent continuous surface beneath the soapholder contacts must also be minimized because liquids will quickly spread to cover as much surface area as possible, causing a liquid emulsion to lose much of its liquid properties through dispersion and evaportion, resulting in the deposition of any transported emulsifiables as a residue upon the surfaces covered.

Despite the necessity of reducing surface area, a small amount of additional area can be tolerated, even useful, if its serves the purpose of draining the contact area between the soap bar and the soapholder. The instant invention provides the additional adjacent surface areas in a downwardly sloping surface which serves to drain the contact area. It should be understood that soap emulsions possess increased viscosity and become somewhat elastic; therefore, if gravity pulls significantly on this liquid at some point, any continuation of the liquid tends to be pulled along to the point of drainage.

By bending the supporting members down to a nearly vertical orientation at the point where soap supporting requirements have been met, the gravitational effect upon the weight of the draining emulsion is fully utilized to pull the maximum amount of liquid from the contact area between soap and soapholder.

In the instant invention, this same effect also applies to any liquid in the contact area between the soap and front stops of the support members. A further benefit of this configuration is the adjustability of contact area to the amount deemed necessary while still supporting the soap bar beneath its points of horizontal balance.

Thusly constructed, the instant invention will cause highly liquid emulsions moving down the lower vertical portions of the support members to exert a pull upon liquid farther up the support members in the contact areas with the soap bar, all the while draining to the lowest points of the supports where it drips into the sink, basin or receptacle being used and ceases to be a cause for further concern.

Owing to the design of the device, the central portion of the soap bar is completely accessible and elevated, with wider access at the rear side of the holder to more nearly match the shape of the human hand, allowing the user to easily grasp the soap bar even if it is freshly dampened and slick, by using the circumferential availablity of position an opposable grip of thumb above and fingers below the soap bar and thence, its unencumbered removal from the holder.

The apparatus according to the instant invention presents a novel configuration which makes use of the natural properties and limitations of liquid soap emulsions to their fullest, to provide greater efficiency, economy and convenience for consumers of bar soap, in a more decorative and attractive fashion than does prior technology.

A number of previous attempts have been made to provide soap holders. Such attempts include U.S. Pat. No. Des. 151,126 to Hilenski, issued Sept. 28, 1948, U.S. Pat. No. 3910661 to Geary, issued Oct. 7, 1975, U.S. Pat. No. Des. 247,999 to Whatley issued May 30, 1978, U.S. Pat. No. Des. 147,306 to Gray issued Feb. 4, 1947, and U.S. Pat. No. 4,621,730 to Mancusi issued Nov. 11, 1976.

None of the known inventions, however, teach a soap bar contact area of the soap holder with horizontal balance points having the optimum amount of support area with structure to remove the emulsified liquid from the points of contact. Also, none of the known art teaches the use of gravity to pull the liquid away from the soap bar by use of a drip point. Furthermore, none of the known art teaches providing a limited surface area beneath contact areas.

SUMMARY OF THE INVENTION

A primary object of this invention is to provide a device which will store bar soap between periods of use, utilizing the physical properties of the materials involved to their utmost to acheive optimum user savings and convenience in a most decorative and attractive fashion.

Another object of this invention is to suspend the soap bar out of contact with any drainage and where possible, to allow the drainage to occur directly over the basin, sink or other receptacle.

A further object of this invention is to provide an apparatus which suspends bar soap in such a fasion that is easily grasped and removed from said apparatus.

A still further object of this apparatus is to provide a variety of attachments to accommodate use on various receiving surfaces to include porcelain sinks and tubs, fiberglass lip type tubs, build-in soap fixtures and also to free stand upon rough surfaces or in drip catching trays.

These objects and other are accomplished by providing a bent wire soap holder having a pair of soap contact supports attached to a base so that the attachment to the base is provided at the rear side of the soap holder and where the soap contact areas slope downwardly from the rear side to the front side. At the front end of the soap holder the soap contact areas further continuously bend downwardly to a V shaped projection or drip point and then extend upwardly to provide a soap bar stop. The termination of the soap bar stop is rounded to prevent injury.

BRIEF DESCRIPTION OF THE DRAWINGS

The advantages of this invention will become apparent upon consideration of the following detailed disclosure of the invention, especially when taken in conjunction with the accompanying drawings, wherein.

DESCRIPTION OF THE PREFERRED EMBODIMENT

Figure 1:
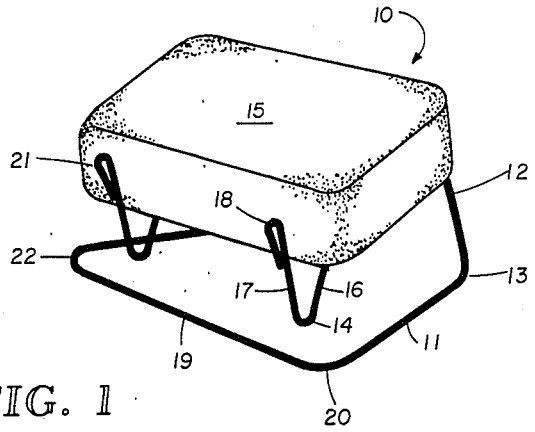
FIG. 1 is a perspective view according to the instant invention wherein a bar of soap is shown resting upon the invention.

With reference to FIG. 1 the invention is depicted generally by numeral 10 in which a bar of soap 15 is shown resting upon the wire soap holer 10. The wire soap holder 10 could be a continuous length of wire or rod such as depicted in FIG. 1 or it could be discontinuous and broken at any portion along the way.

Figure 2:
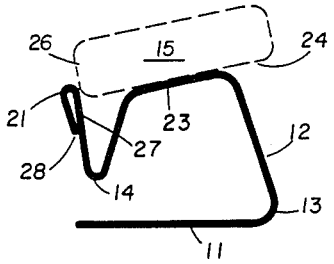
FIG. 2 is a right side elevational view of the invention wherein the bar of soap is shown in dashed lines.
Figure 3:
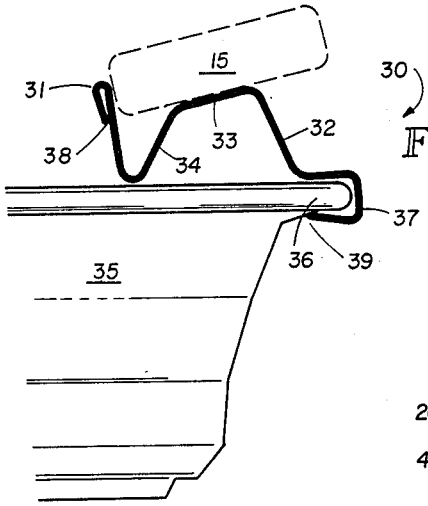
FIG. 3 is a right side elevational view of the second embodiment of the invention in which the base has been changed to a basin attachment and the soap bar is shown in dashed lines.
Figure 4:
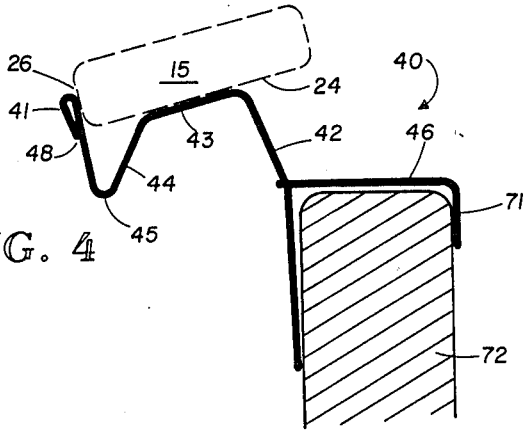
FIG. 4 is a third embodiment of the instant invention whereby the attachment is for a sink wall or other structure.
Figure 5:
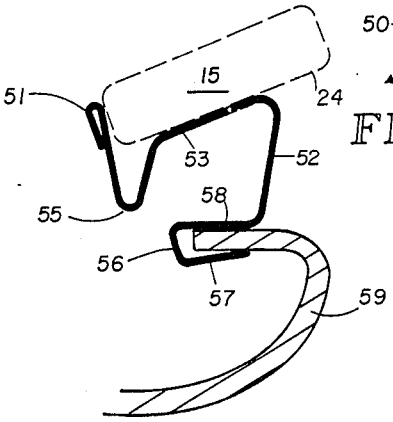
FIG. 5 is a fourth embodiment of the invention wherein the attachment is to the inner lip of a tub or basin.

The support for soap bar 15 is provided by parallel contact bars as depicted in FIG. 2. Further with reference to FIG. 2 it can be seen that on an end view the device 10 is seen to provide the soap bar contact portion 23 and the downwardly depending drip point 14 as well as a base or stand 11. The base 11 could be further altered in other embodiments so that it could rest upon a flat surface such as the edge of a wash basin or could be made to conform to that wash basin edge of any other convenient supporting surface such as shown in FIGS. 3, 4, and 5.

In order to provide for drip point 14 it is necessary that contact area 23 be slanted so that any moisture will run down from contact area 23 to drip point 14. By so having contact areas 23 slanted it is necessary to have a stop against which the leading edge 26 of bar 15 will rest. The stop is provided by stop tips 21 and 18 as depicted in FIG. 1. So that bar 15 does not fall off of contact points 23.

It can readily be seen in FIG. 1 that if soap bar 15 were wet that any moisture would drain down from contact area 23 by way of downwardly depending length 16 to drip point 14. Upwardly depending length 17 which terminates in stop tip 18 provides for stopping bar 15 from sliding forward and off of soap holder 10 as previously described.

It is contemplated that the wire soap holder be made of wire, however, any convenient material would be suitable as long as it maintained the proper configuration. Possibilities for construction of the soap holder would include casting, stamping, or injection molding. The device could be made in continuous length or in pieces which could be snapped together.

With reference now to FIG. 3, it can be seen that the second embodiment 30 of the invention is provided in which the base has been changed to an attachment for a sink or outside lip 36 of a basin 35. The wire could thus be bent around the lip 36 so that gripping point 39 would provide sufficient strength to keep the device elevated above basin 35. The contact areas 33 act similarly to the contact areas 23 in the previous discussion with respect to the preferred embodiment. Also, stop tips 31 are the same as in the preferred embodiment. It should be noted that a pair of contact areas 33 would be utilized in a similar manner as depicted in FIG. 1 to support the soap bar 15 except that the base would be altered to provide an attachment as depicted in FIG. 3.

With reference now to FIG. 4, it can be seen that the base has been further altered to provide a gripping surface for tub lip 72 so that wire supporting surfaces 42, 46, and 71 grip tub lip 72 to firmly support the contact areas 43 with drip point 45 and stop tips 41.

With reference to FIG. 5, a further embodiment is depicted wherein the base of the preferred embodiment has been modified to support the inner lip of a basin or tube 59. Once again, parallel contact areas 53 with drip points 55 and stop tips 51 are constructed similarly to the preferred embodiment.

As follows, with reference to FIG. 6 a further embodiment is depicted wherein the base of the preferred embodiment has been modified so as to be attached to a flat surface 101 such as the edge of a tub, sink, or any particular flat surface. Once again, parallel contact areas 63 with drip point 69 and stop tip 61 are constructed similarly to the preferred embodiment. The extension of the holder 60 includes arms 67 which extend into rubberized or plastic bulb 80 which is attached to a suction cup 81 for gripping onto flat surface 101.

The use of the device will now be described. As depicted in FIG. 1, when one needs to rest the soap bar for drainage after it is wet, it only necessary to place bar 15 upon soap holder 10 so that it rests upon parallel contact areas 23 in a manner as shown in FIG. 1. Any liquid remaining on bar 15 will run downwardly along length 16 to drip point 14 and drip off, thus leaving soap bar 15 dry and having its essential oils. It will be noted that stop tips 21 have been bent over so that tips 28 as shown in FIG. 2 are not so sharp as to cause injury.

Figure 6:
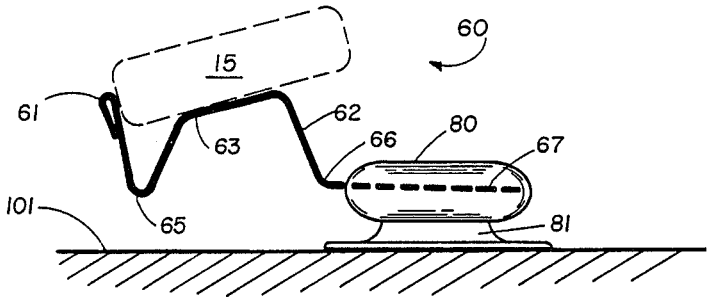
FIG. 6 is a fifth embodiment of the invention whereas the attachment is provided with a rubber suction cup to attach to a flat base.

For using the device with other attachments such as depicted in the second, third, fourth, and fifth embodiments, (FIGS. 3, 4, 5, and 6) it is only necessary that the base area be changed to attach to basin 35 as shown in FIG. 3, tub lip 72 as depicted in FIG. 4, basin inner lip 59 as depicted in FIG. 5, or flat surface 101 as depicted in FIG. 6. The resting of bar 15 on all embodiments is the same regardless of the base. The working features are the parallel contact surfaces 23, the drip points 14 and the stop tips 18.

Although specific applications, materials, components, connections, sequences of events, and methods have been stated in the above description of the preferred embodiment of the invention, other suitable materials, other applications, components and process steps as listed herein may be used with satisfactory results and varying degrees of quality. In addition, it will be understood that various other changes in details, materials, steps, arrangements of parts and uses which have been herein described and illustrated in order to explain the nature of the invention will occur to and may be made by those skilled in the art, upon a reading of this disclosure, and such changes are intended to be included within the principles and scope of this invention as hereinafter claimed.

I claim:

1. A soap holder comprising:

a base means;

a pair of soap contact means attached to said base means, wherein said soap contact means define a plane of soap contact; and a pair of drip points respectively attached to each of said soap contact means, said drip points being attached to and positioned below the plane of soap contact defined by said soap contact means.

2. A soap holder as described in claim 1 wherein said soap contact means are spaced to provide access for gripping a soap bar resting upon said contact areas.

3. The soap holder is described in claim 1 wherein each of said contact means is comprised of a rod.

4. The soap holder is described in claim 1 wherein said soap contact areas, said drip points, and said base means are comprised of bent wire.

5. The soap holder as described in claim 4 wherein said wire is coated.

6. The soap holder as described in claim 1 wherein said frontal stop means comprises a rod upwardly extending from each of said drip points to above said contact means.

7. The soap holder as described in claim 6 wherein said frontal stop means are rounded.

8. The soap holder as described in claim 7 wherein said pair of soap contact means are spaced so that the distance between the rear sides of the contact means is greater than the space between the front sides of said contact means.

9. The soap holder as described in claim 8 wherein the base means is adapted for attachment to a basin having an outwardly depending lip.

10. The soap holder as described in claim 8 wherein the base means is adapted for attachment to a tub having an outwardly depending lip.

11. The soap holder as described in claim 8 wherein the base means is adapted for attachment to a basin having an inwardly projecting lip.

12. The soap holder as described in claim 8 wherein the base means is adapted for attachment to a flat surface.

13. The soap holder as described in claim 12 further comprising a suction cup attached to the base means.

* * * * *